US008063345B2

(12) United States Patent
Middleton et al.

(10) Patent No.: US 8,063,345 B2
(45) Date of Patent: Nov. 22, 2011

(54) MICROWAVABLE FOOD PACKAGE HAVING AN EASY-OPEN FEATURE

(75) Inventors: Scott W. Middleton, Oshkosh, WI (US); Jeffery S. Majetich, Sherwood, WI (US); Laurence M. C. Lai, Mississauga (CA); Daniel Keefe, Acworth, GA (US); Neilson Zeng, North York (CA)

(73) Assignee: Graphic Packaging International, Inc., Marietta, GA (US)

( * ) Notice: Subject to any disclaimer, the term of this patent is extended or adjusted under 35 U.S.C. 154(b) by 335 days.

(21) Appl. No.: 12/313,651

(22) Filed: Nov. 21, 2008

(65) Prior Publication Data

US 2009/0078698 A1 Mar. 26, 2009

Related U.S. Application Data

(63) Continuation of application No. 11/402,148, filed on Apr. 11, 2006, now abandoned.

(60) Provisional application No. 60/669,978, filed on Apr. 11, 2005.

(51) Int. Cl.
*H05B 6/80* (2006.01)
*H05B 6/64* (2006.01)

(52) U.S. Cl. ..... 219/730; 219/728; 219/729; 426/107

(58) Field of Classification Search ..... 219/727–730; 426/107; 493/59; 428/34.2
See application file for complete search history.

(56) References Cited

U.S. PATENT DOCUMENTS

| | | | | |
|---|---|---|---|---|
| 3,183,800 | A * | 5/1965 | Farrell et al. | 493/59 |
| 3,315,873 | A | 4/1967 | Strange | |
| 4,592,914 | A | 6/1986 | Kuchenbecker | |
| 4,626,641 | A | 12/1986 | Brown | |
| 4,775,771 | A | 10/1988 | Pawlowski | |
| 4,785,160 | A | 11/1988 | Hart | |
| 4,865,921 | A | 9/1989 | Hollenberg | |
| 4,890,439 | A | 1/1990 | Smart | |
| 4,891,482 | A | 1/1990 | Jaeger et al. | |
| 4,936,935 | A | 6/1990 | Beckett | |
| 4,963,424 | A | 10/1990 | Beckett | |
| 5,039,364 | A | 8/1991 | Beckett | |
| 5,071,062 | A | 12/1991 | Bradley et al. | |
| 5,117,078 | A | 5/1992 | Beckett | |
| 5,213,902 | A | 5/1993 | Beckett | |
| 5,221,419 | A | 6/1993 | Beckett | |
| 5,260,537 | A | 11/1993 | Beckett | |

(Continued)

FOREIGN PATENT DOCUMENTS

EP 0 916 594 A2 5/1999

(Continued)

OTHER PUBLICATIONS

Notice of Allowance and Issue Fee dated Dec. 18, 2009, U.S. Appl. No. 11/906,371.

(Continued)

*Primary Examiner* — Quang Van
(74) *Attorney, Agent, or Firm* — Womble Carlyle Sandridge & Rice, LLP

(57) ABSTRACT

A system for heating a food item in a microwave oven is provided. The system may include an inner container and an outer carton including an opening feature that allows for easy opening thereof. The system also may include a microwave energy interactive element.

34 Claims, 9 Drawing Sheets

U.S. PATENT DOCUMENTS

| | | | | |
|---|---|---|---|---|
| 5,266,386 | A | 11/1993 | Beckett | |
| 5,288,962 | A | 2/1994 | Lorence et al. | |
| RE34,683 | E | 8/1994 | Maynard | |
| 5,340,436 | A | 8/1994 | Beckett | |
| 5,354,973 | A | 10/1994 | Beckett | |
| 5,410,135 | A | 4/1995 | Pollart | |
| 5,424,517 | A | 6/1995 | Habeger | |
| 5,468,939 | A | 11/1995 | MacLean, IV | |
| 5,519,195 | A | 5/1996 | Keefer | |
| 5,628,921 | A | 5/1997 | Beckett | |
| 5,672,407 | A | 9/1997 | Beckett | |
| 5,759,422 | A | 6/1998 | Schmelzer | |
| 5,800,724 | A | 9/1998 | Habeger | |
| 5,968,616 | A * | 10/1999 | Kakemura et al. | 428/34.2 |
| 6,114,679 | A | 9/2000 | Lai | |
| 6,150,646 | A | 11/2000 | Lai | |
| 6,204,492 | B1 | 3/2001 | Zeng | |
| 6,224,918 | B1 | 5/2001 | Weisenfeld et al. | |
| 6,251,451 | B1 | 6/2001 | Zeng | |
| 6,259,079 | B1 | 7/2001 | Ji et al. | |
| 6,410,065 | B1 | 6/2002 | Nottingham et al. | |
| 6,414,290 | B1 | 7/2002 | Cole | |
| 6,433,322 | B2 | 8/2002 | Zeng | |
| 6,436,457 | B1 | 8/2002 | Poss | |
| 6,455,827 | B2 | 9/2002 | Zeng | |
| 6,552,315 | B2 | 4/2003 | Zeng | |
| 6,559,431 | B2 | 5/2003 | Hopkins | |
| 6,677,563 | B2 | 1/2004 | Lai | |
| 6,717,121 | B2 | 4/2004 | Zeng | |
| 6,765,182 | B2 | 7/2004 | Cole | |
| 7,019,271 | B2 | 3/2006 | Wnek et al. | |
| 7,345,262 | B2 | 3/2008 | Keefe | |
| 7,351,942 | B2 | 4/2008 | Wnek et al. | |
| 2001/0001674 | A1 | 5/2001 | Simpson | |
| 2002/0100755 | A1 | 8/2002 | Peterson | |
| 2003/0085224 | A1 | 5/2003 | Tsontzidis et al. | |
| 2003/0111463 | A1 | 6/2003 | Lai | |
| 2005/0230384 | A1 * | 10/2005 | Robison et al. | 219/730 |
| 2006/0049190 | A1 | 3/2006 | Middleton | |
| 2007/0102424 | A1 | 5/2007 | Keefe | |
| 2007/0194012 | A1 | 8/2007 | Middleton et al. | |
| 2008/0047957 | A1 | 2/2008 | Keefe | |

FOREIGN PATENT DOCUMENTS

| | | | |
|---|---|---|---|
| EP | 1 067 055 | A2 | 1/2001 |
| EP | 1 230 133 | B1 | 8/2002 |
| EP | 1 452 458 | | 1/2004 |
| EP | 1 481 922 | A2 | 12/2004 |
| FR | 2 805 801 | | 9/2001 |
| GB | 2 194 515 | A | 3/1988 |
| WO | WO 97/39949 | | 10/1997 |
| WO | WO 01/92134 | A1 | 12/2001 |
| WO | WO 03/066435 | A2 | 8/2003 |
| WO | WO 2006/110685 | | 10/2006 |

OTHER PUBLICATIONS

International Search Report—PCT/US2006/13370.

Written Opinion—PCT/US2006/13370.

* cited by examiner

MICROWAVABLE FOOD PACKAGE HAVING AN EASY-OPEN FEATURE

CROSS-REFERENCE TO RELATED APPLICATIONS

This application is a continuation of co-pending U.S. patent application Ser. No. 11/402,148, filed Apr. 11, 2006, now abandoned, which claims the benefit of U.S. Provisional Application. No. 60/669,978, filed Apr. 11, 2005, both of which are incorporated by reference herein in their entirety.

TECHNICAL FIELD

The present invention relates to a package for a food item, and particularly relates to a package for heating a food item in a microwave oven.

BACKGROUND

Microwave ovens have become a principle form of heating food in a rapid and effective manner. Various attempts have been made to provide microwave food packages that produce effects associated with foods cooked in a conventional oven. Such packages must be capable of controlling the distribution of energy around the food item, utilizing the energy in the most efficient manner, and ensuring that the food item and the container provide a pleasant and acceptable finished food item.

To do so, many microwave food packages include one or more microwave energy interactive elements. Such elements typically comprise one or more microwave energy interactive materials that absorb, reflect, or transmit microwave energy in varying proportions. For example, it is possible to shield portions of the food item without absorbing or transmitting microwave energy, which may be particularly important for the heating of food items having a mass of greater than about 400 grams. Where surface browning and/or crisping is desired, a microwave energy interactive element that absorbs microwave energy may be used. Such an element becomes hot when exposed to microwave energy, thereby increasing the amount of heat supplied to the exterior of the food item. Additionally, some of the microwave energy may be transmitted to heat the inside of the food item.

Several factors complicate the design of a microwavable package for a food item. For example, various food items have different sizes, microwave heating characteristics, and different needs for bulk heating, browning, and/or crisping. As a result, each package must be tailored to each type of food item. At the same time, manufacturers of food items often prefer to use the same type of container to hold numerous different food items. Furthermore, various microwave ovens provide varying cook times for a particular food item. As such, despite recommended cook times provided by the food manufacturer, the consumer often must halt the cooking cycle to examine the food item to determine whether the item is sufficiently cooked. In doing so, the microwave energy interactive features often are damaged and rendered ineffective.

Therefore, there is a need for a microwavable package that provides the desired level of heating, browning, and/or crisping of the food item therein. There is a further need for a package or system that allows the user to view the food item during the cooking or heating cycle without damaging any microwave energy interactive features that might be present. There is a still further need for a package or system that satisfies the preference of the food manufacturer to use a standard container for many different food items, while providing the benefits associated with microwave energy interactive packages.

SUMMARY

The present invention is directed generally to a carton or package (referred to generally herein as a "construct") for cooking or heating a food item in a microwave oven. In one aspect, the construct includes at least one opening feature that permits easy and convenient opening of the construct to inspect a food item therein during cooking. The construct also may include one or more microwave energy interactive elements that selectively reflect, absorb, or transmit microwave energy.

In another aspect, the construct may serve as an outer or secondary carton into which a primary food container is inserted. The primary container may be any suitable carton, tray, sleeve, pouch, or other container, for example, a thermally formed plastic and/or paperboard tray. In this aspect, the secondary package includes at least opening feature that allows the construct to be opened to view the food item during cooking without damaging any microwave energy interactive elements.

In one particular aspect of the invention, a blank for forming a carton includes a first panel including an at least partially removable portion defined by at least one tear line, a second panel, and a microwave energy interactive element overlying at least a portion of the second panel. The microwave energy interactive element may comprise a microwave energy shielding element, a microwave energy distributing element, or any other microwave interactive element, as needed or desired.

In one variation of this aspect, the at least one tear line comprises a first tear line and a second tear line arranged in a substantially parallel configuration, the first tear line and the second tear line being substantially perpendicular to a first edge of the first panel, a third tear line initiating and terminating proximate to a second edge of the top panel, a fourth tear line substantially coterminous with the first tear line and extending substantially to the third tear line, and a fifth tear line substantially coterminous with the second tear line and extending substantially to the third tear line. The fourth tear line and the fifth tear line may be extend convergently toward each other, or many have any other configuration. If desired, the first edge of the top panel may at least partially comprise a tear line.

In one example of this variation, the first tear line and the second tear line each independently have a first endpoint and a second endpoint, the first endpoint of each of the first tear line and the second tear line independently is proximate to the first edge of the top panel, and the fourth tear line and the fifth tear line extend respectively from the second endpoint of the first tear line and the second tear line.

In another example of this variation, the first tear line and the second tear line each independently have a first endpoint and a second endpoint, and the blank further comprises a sixth tear line extending from a first corner of the top panel proximate to the first edge, the sixth tear line being substantially coterminous with the first tear line at the first endpoint thereof, and a seventh tear line extending from a second corner of the top panel proximate to the first edge, the seventh tear line being substantially coterminous with the second tear line at the first endpoint thereof. In this example, the sixth tear line and the seventh tear line may be extend convergently toward each other, and the fourth tear line and the fifth tear line may be substantially coterminous respectively with first tear line and the second tear line at the respective second endpoints thereof. A fold line may extend between the first tear line and the second tear line. The fold line may be substantially perpendicular to each of the first tear line and the second tear line.

In another variation of this aspect, the at least one tear line comprises a first tear line substantially perpendicular to a first edge of the first panel, the first tear line having a first endpoint proximate to the first edge of the first panel, a second tear line substantially coterminous with the first tear line at the second endpoint of the first tear line, the second tear line terminating proximate to a second edge of the first panel, a third tear line substantially parallel to the first tear line, the third tear line having a first endpoint and a second endpoint, a fourth tear line extending proximately from a corner of the first panel toward the third tear line, the fourth tear line being substantially coterminous with the third tear line at the first endpoint of the third tear line, and a fifth tear line substantially coterminous with the third tear line at the second endpoint of the third tear line, the fifth tear line terminating proximate to the second edge of the first panel.

If desired, the second tear line and the fifth tear line may be extend convergently toward each other. The blank also may include a pair of spaced apart notches in the first panel along the second edge thereof. In one example of this variation, the blank further includes a sixth tear line extending from the second endpoint of the third tear line toward the second edge of the first panel, the sixth tear line being oriented toward a second corner of the first panel.

In another particular aspect, the present invention encompasses a carton for heating a food item therein. The carton comprises a first panel including an at least partially removable portion defined by at least one tear line, and a second panel including a microwave energy shielding element overlying at least a portion of a peripheral area thereof, and a microwave energy distributing element overlying at least a portion of a central area thereof.

In one variation of this aspect, the carton further comprises at least one panel adjacent to and substantially perpendicular to the second panel, wherein the microwave energy shielding element overlies at least a portion of each adjacent and substantially perpendicular panel. In another variation, the microwave energy distributing element comprises a plurality of spaced apart metallic foil segments arranged in a plurality of clusters. In still another variation the microwave energy distributing element comprises a plurality of spaced apart metallic foil segments arranged in a lattice-like configuration.

If desired, the carton may include a viewing window comprising a transparent material. The transparent material may comprise a polymeric film and, optionally, a microwave energy interactive material. In one example, the transparent material comprises indium tin oxide supported on a polymeric film. If desired, the viewing window may form at least a portion of the first panel. In another example, the viewing window forms a portion of the first panel, the first panel is a top panel of the carton, and the second panel is a bottom panel of the carton.

In another aspect of the invention, a package or system for heating a food item in a microwave oven is provided. The package comprises a container for receiving the food item therein and a carton dimensioned to receive the container. The carton includes a first panel comprising an at least partially removable portion defined by at least one tear line, and a second panel on which the container is supported. The second panel comprises a microwave energy interactive element.

In one variation of this aspect, the microwave energy interactive element comprises a microwave energy shielding element. In one example, the microwave energy shielding element may comprise a metal foil extending along a periphery of the second panel. In another example, the microwave energy shielding element may comprise a metal foil overlying a peripheral portion of the second panel and at least a portion of at least one adjacent panel.

In another variation, the microwave energy interactive element comprises a microwave energy distributing element. In one example of this variation, the microwave energy distributing element comprises a plurality of spaced apart metallic foil segments arranged in a plurality of clusters. If desired, the plurality of clusters may be arranged in a lattice-like configuration. The plurality of spaced apart metallic foil segments in each of the clusters comprises four metallic segments, each resembling a quadrant of a circle.

In still another variation, the carton includes a transparent portion through which the container can be viewed. In one example, the transparent portion may comprise a susceptor film, for example, indium tin oxide supported on a transparent polymeric film.

In yet another variation the container may be formed from a polymeric material, a paper, a paperboard, or any combination thereof, for example, polyethylene terephthalate.

Additional aspects, features, and advantages of the present invention will become apparent from the following description and accompanying figures.

BRIEF DESCRIPTION OF THE DRAWINGS

The description refers to the accompanying drawings in which like reference characters refer to like parts throughout the several views, and in which.

DETAILED DESCRIPTION

Various aspects of the invention may be illustrated by referring to the figures. For purposes of simplicity, like numerals may be used to describe like features. It will be understood that where a plurality of similar features are depicted, not all of such features necessarily are labeled on each figure. Although several different exemplary aspects, implementations, and embodiments of the various inventions are provided, numerous interrelationships between, combinations thereof, and modifications of the various inventions, aspects, implementations, and embodiments of the inventions are contemplated hereby.

Figure 1:
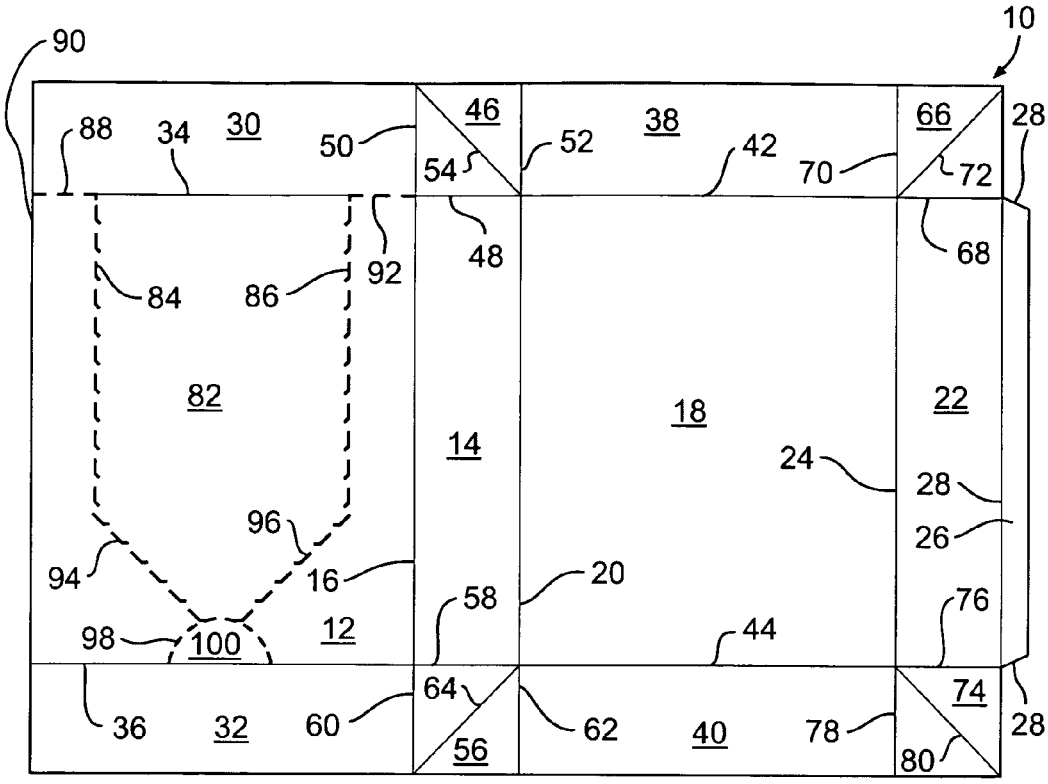
FIG. 1 depicts an exemplary blank that may be used to form a construct according to various aspects of the present invention.

FIG. 1 depicts an exemplary blank 10 in accordance with various aspects of the present invention. The blank 10 generally includes a first major panel or top panel 12 joined to a first minor panel or first side panel 14 along a fold line 16, and a second major panel or bottom panel 18 joined to the first side panel 14 along a fold line 20. A second minor panel or second side panel 22 is joined to the bottom panel 18 along a fold line 24. A glue flap 26 is joined to the second side panel 22 along a fold line 24. In this example, the glue flap 26 is somewhat trapezoidal in shape with clipped corners 28. However, it will be understood that other flap shapes are contemplated hereby.

A first top end panel 30 and a second top end panel 32 are joined to the top panel 12 along respective fold lines 34 and 36. Likewise, a first bottom end panel 38 and a second bottom end panel 40 are joined to the bottom panel 18 along respective fold lines 42 and 44. A first corner panel 46 is joined to the first side panel 14, the first top end panel 30, and the first bottom end panel 38 along respective fold lines 48, 50, and 52. A fold line 54 extends between fold lines 50 and 52 and bisects corner panel 46. A second corner panel 56 is joined to the first side panel 14, the second top end panel 32, and the second bottom end panel 40 along respective fold lines 58, 60, and 62. A fold line 64 extends between fold lines 60 and 62 and bisects corner panel 56. A third corner panel 66 is joined to the second side panel 22 and the first bottom end panel 38 along respective fold lines 68 and 70. A fold line 72 extends diagonally from the junction of fold lines 68 and 70 and bisects corner panel 66. A fourth corner panel 74 is joined to the second side panel 22 and the second bottom end panel 38 along respective fold lines 76 and 78. A fold line 80 extends diagonally from the junction of fold lines 76 and 78 and bisects corner panel 74.

Still viewing FIG. 1, the top panel 12 includes an at least partially removable panel or portion 82. The panel or portion need not be completely separated or separable from the panel to be considered "removable". Instead, it will be understood that the term "removable" may be used to describe a panel or portion that is not separated at all but that is capable of being separated at least partially, one that is separated partially or separable partially, one that is separated substantially or separable substantially, or one that is separated completely or separable completely from the remainder of the panel in which it lies. In general terms, the removable panel comprises an opening that is filled, covered, or concealed by a portion of a panel of the blank, such that when the blank is formed into a construct, the concealing portion may be removed from the construct to reveal a opening that provides access to the interior of the construct. The removable panel or portion may be defined by a plurality of weakening perforations, linear or angled cuts or score lines, kiss cut lines, or other tear lines as desired (collectively referred to herein as "tear lines"). Such tear lines may extend through all or a portion of the thickness of the panel in which it lies.

Returning to FIG. 1, the blank 10 includes two parallel tear lines 84 and 86 that extend from fold line 34 towards fold line 36. A first tear line segment 88 extends between and is substantially perpendicular to edge 90 and tear line 84. A second tear line segment 92 extends between and is substantially perpendicular to tear line 86 and fold line 16. Angular or oblique tear lines 94 and 96 are substantially coterminous with respective endpoints of parallel tear lines 84 and 86, respectively, and extend convergently toward each other and terminate proximate to an arcuate tear line 98. Tear lines 84, 94, 96, 86 and fold line 34 collectively define the removable panel 82. Arcuate tear line 98 initiates and terminates proximate to fold line 36 to form a semi-circular or arcuate panel 98.

In this and other aspects of the invention, it will be understood that although exemplary panel or portion shapes are illustrated herein, other panel shapes are contemplated hereby. Further, it will be understood that although the removable panel is described herein as forming a portion of the top panel, the removable panel may be located anywhere on the blank or construct formed therefrom. Thus, one or more opening features, for example, removable portions, may be on a side panel or otherwise, as desired.

Figure 2:
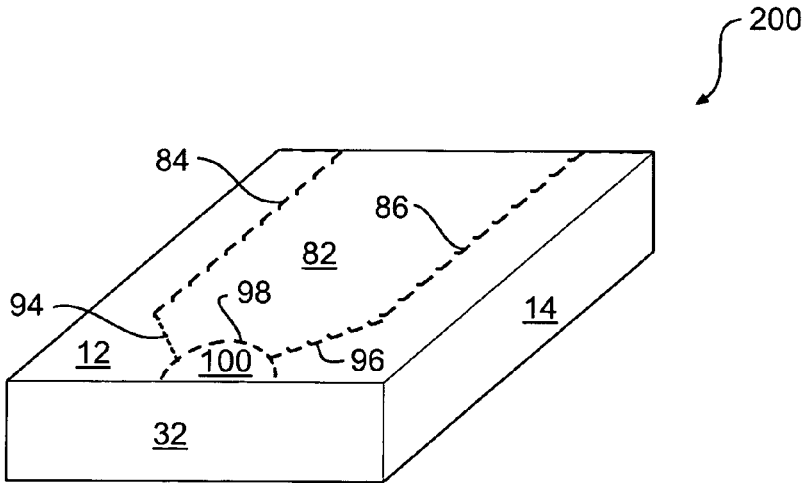
FIG. 2 depicts an exemplary construct formed from the blank of FIG. 1.

Turning to FIG. 2, to form a construct 200 from the blank 10, panels 14, 22, 32, and 40 generally are folded towards the bottom panel 18. Flap 26 and corner panels 46, 56, 66, 74 are folded inward along oblique fold lines 54, 56, 72, 80 toward the interior of the construct 102 to be formed. Alternatively, flap 26 and corner panels 46, 56, 66, 74 may be folded outward along oblique fold lines 54, 56, 72, 80 toward the exterior of package 102 to be formed. Top panel 12 is brought into alignment with bottom panel 18 by folding along fold lines 16 and 20. The first and second top end panels 30 and 32 then are folded toward the bottom panel 18 and brought into alignment with the first bottom end panel 38 and the second bottom end panel, 40, respectively. If desired, an adhesive may be used to secure the various panels and flaps into the desired configuration. For example, adhesive may be used to join flap 26 to top panel 12, top end panels 30 and 32 to bottom end panels 38 and 40, respectively, and so forth. While particular examples of sequences for transforming the blank into a construct are provided herein, it will be understood that numerous sequences and steps may be used to form a construct according to the present invention.

To open the construct 200, the user may depress a finger or a utensil against panel 100, thereby initiating a tear along tear line 98 and creating an opening (not shown). The user then is able to insert a finger into the opening and lift the removable panel 82 in a direction away from the top panel 12, continuing to tear the panel 82 along tear lines 84 and 86 and, if desired, along tear lines 88 and 90. The user may separate the removable panel to any extent necessary or desired to view the food item (not shown) inside. If the user determines that additional heating or cooking is needed or desired, the user simply returns the removable panel 82 to its original position aligned with the remainder of the top panel 12. When the food item is heated to the desired temperature, the user may remove the food item from the package. If desired, the user may tear the top panel 12 along tear line segments 88 and/or 92 to separate the top panel 12 further, for example, to remove a food item therein.

Figure 3:
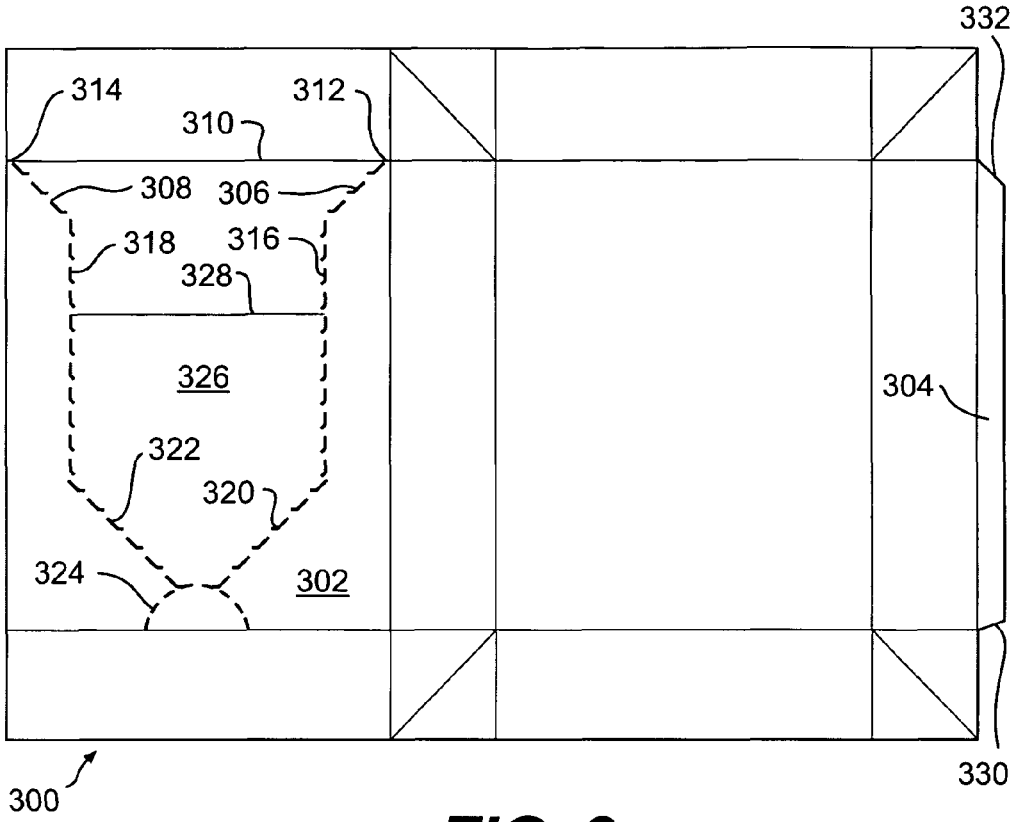
FIG. 3 depicts another exemplary blank that may be used to form a construct according to various aspects of the present invention.

FIG. 3 depicts another exemplary blank 300 according to the present invention. The blank 300 includes several features similar to those of FIG. 1, and such features are not discussed again with respect to FIG. 3. However, in the exemplary blank 300 of FIG. 3, an alternate top panel 302 and glue flap 304 are provided. In this example, oblique tear lines 306 and 308 extend angularly towards each other from fold line 310. Oblique tear lines 306 and 308 may extend proximately from the corners 312 and 314, respectively, of the top panel 302 or may extend from any suitable location along fold line 310 as needed to obtain the desired opening size and configuration. Substantially parallel tear lines 316 and 318 extend from an endpoint of oblique tear lines 306 and 308, respectively, and are substantially coterminous with oblique tear lines 320 and 322, respectively. Oblique tear lines 320 and 322 extend toward each other and terminate at arcuate tear line 324. Tear lines 306, 308, 316, 318, 320, 322, a portion of tear line 324, and fold line 310 collectively define a removable panel 326 that may be at least partially separated from top panel 302. Removable panel 326 includes a transverse fold line 328 ext ending between substantially parallel tear lines 316 and 318. Glue flap 304 includes clipped corners 330 and 332, with corner 332 being angled more sharply to accommodate tear line 308 when the blank is folded into a construct (FIG. 4).

Figure 4:
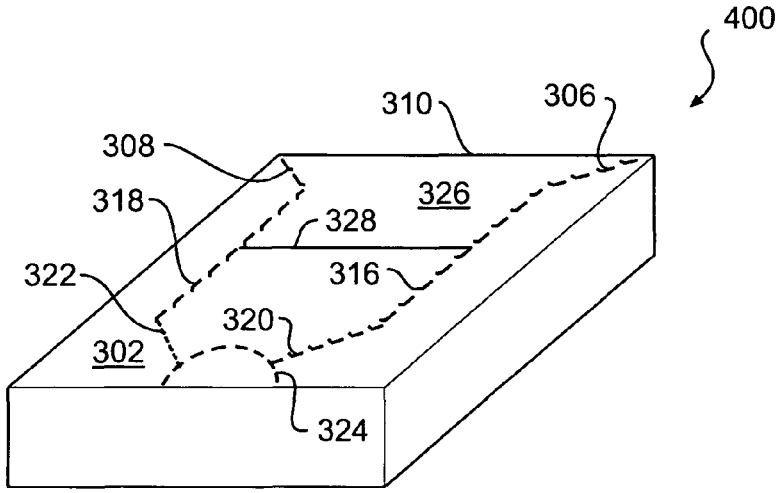
FIG. 4 depicts an exemplary construct formed from the blank of FIG. 3.

Turning to FIG. 4, a construct 400 may be formed from the blank 300 and used in a manner similar to that described in connection with FIG. 2, except that transverse fold line 328 is provided as a convenient feature for folding the removable panel 326 away from the remainder of the top panel 302 to a predetermined open configuration.

Figure 5:
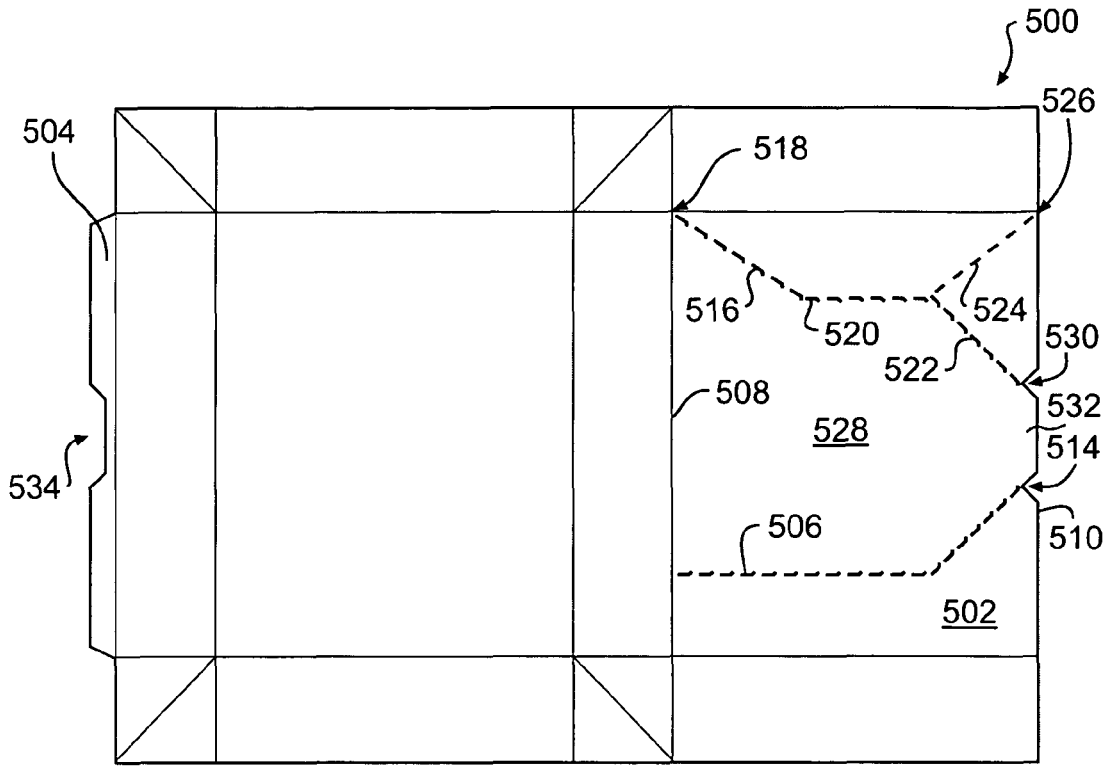
FIG. 5 depicts yet another exemplary blank that may be used to form a construct according to various aspects of the present invention.

FIG. 5 illustrates yet another exemplary blank 500 according to the present invention. The blank 500 includes several features similar to those of FIGS. 1 and 3, and such features are not discussed again with respect to FIG. 5. However, in the exemplary blank 500 of FIG. 5, an alternate top panel 502 and glue flap 504 are provided.

In this example, a tear line 506 extends substantially perpendicularly from fold line 508 towards edge 510 and is substantially coterminous with angular tear line 512. Angular tear line 512 terminates at notch 514 along edge 510 of the top panel 502. The top panel 502 further includes an angular tear line 516, which extends angularly from the corner 518 of the top panel 502 towards edge 510. Angular tear line 516 is substantially coterminous with tear line 520, which is substantially parallel to tear line 506. Tear line 522 is substantially coterminous with angular tear line 522, which extends toward the edge 510 of the top panel 502. Additionally, tear line 524 extends from the junction of tear line 520 and tear line 522 toward the corner 526 of the top panel 502. Tear lines 509, 512, 516, 520, 522 and a portion of fold line 508 define a removable panel 528 that is capable of being separated at least partially from the remainder of the top panel 502.

Optionally, the top panel 502 includes one or more notches 514, 530 that define a tab 532 in the top panel 502 proximate to edge 510. As can be seen in FIG. 5, a cutout 534 in glue flap 504 is aligned with tab 532 so that tab 532 remains unhindered when a construct is formed from the blank 500. The tab 532 may be grasped by the user to initiate separation of the removable panel 528 from the top panel 502.

Figure 6:
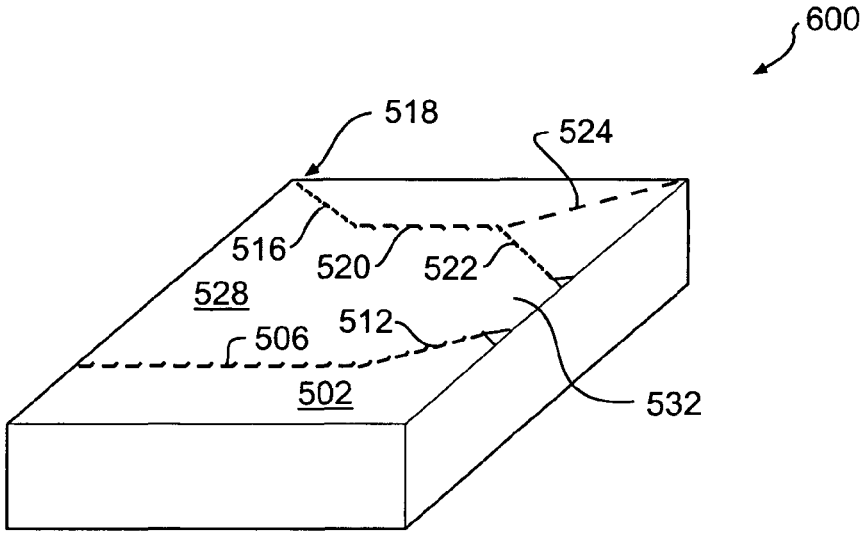
FIG. 6 depicts an exemplary construct formed from the blank of FIG. 5.

Now viewing FIG. 6, a construct 600 may be formed from the blank 500 and used in a manner similar to that described in connection with FIGS. 2 and 4. In this example, the removable panel 528 extends to corner 518 to allow greater access to the food item (not shown) therein. Also, tear line 524 is provided to gain further access to the food item when it is ready to be consumed.

According to various aspects of the invention described herein or others contemplated hereby, the container may include features that alter the effect of microwave energy during the heating or cooking of the food item. For example, any of the containers may be formed at least partially from one or more microwave energy interactive elements (hereinafter referred to as "microwave interactive elements") that promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating container and food item. The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs may be referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In one example, the microwave interactive element may comprise a thin layer of microwave interactive material that tends to absorb microwave energy, thereby generating heat at the interface with a food item. Such elements often are used to promote browning and/or crisping of the surface of a food item (sometimes referred to as a "browning and/or crisping element" or "suscepting element"). When supported on a film or other substrate, such an element may be referred to as a "susceptor" or "susceptor film".

As another example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, where a microwave energy interactive material is used to form at least a portion of the construct, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to escape from the interior of the construct.

As stated above, any of the above elements and numerous others contemplated hereby may be supported on a substrate. The substrate typically comprises an electrical insulator, for example, a polymeric film. The thickness of the film may typically be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one aspect, the polymeric film may comprise polyethylene terephthalate. Examples of polyethylene terephthalate films that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIKWAVE® Focus susceptor and the MICRORITE® susceptor, both available from Graphic Packaging International (Marietta, Ga.).

In another aspect, the polymeric film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.).

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) as measuring using ASTM F 1249 of less than about 100 $g/m^2/day$. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 g/m$^2$/day. In still another aspect, the barrier film has a WVTR of less than about 0.1 g/m$^2$/day. In a still further aspect, the barrier film has a WVTR of less than about 0.05 g/m$^2$/day.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The susceptor film then may be joined to a supporting material or layer or "support" that provides structural integrity to the susceptor film. If desired, the susceptor film may be joined to the material that forms the blank, for example, a paper or paperboard material.

Where a paperboard is used, the paperboard may have a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International. If needed or desired, one or more portions of the paper or paperboard may be coated with varnish, clay, or other materials, either alone or in combination. The coating may then be printed over with product advertising or other information or images. The blanks or constructs also may be coated to protect any information printed thereon. Alternatively or additionally, any of the blanks or constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. US 2006-0049190 A1, published Mar. 9, 2006, both of which are incorporated herein by reference in their entirety.

Figure 7:
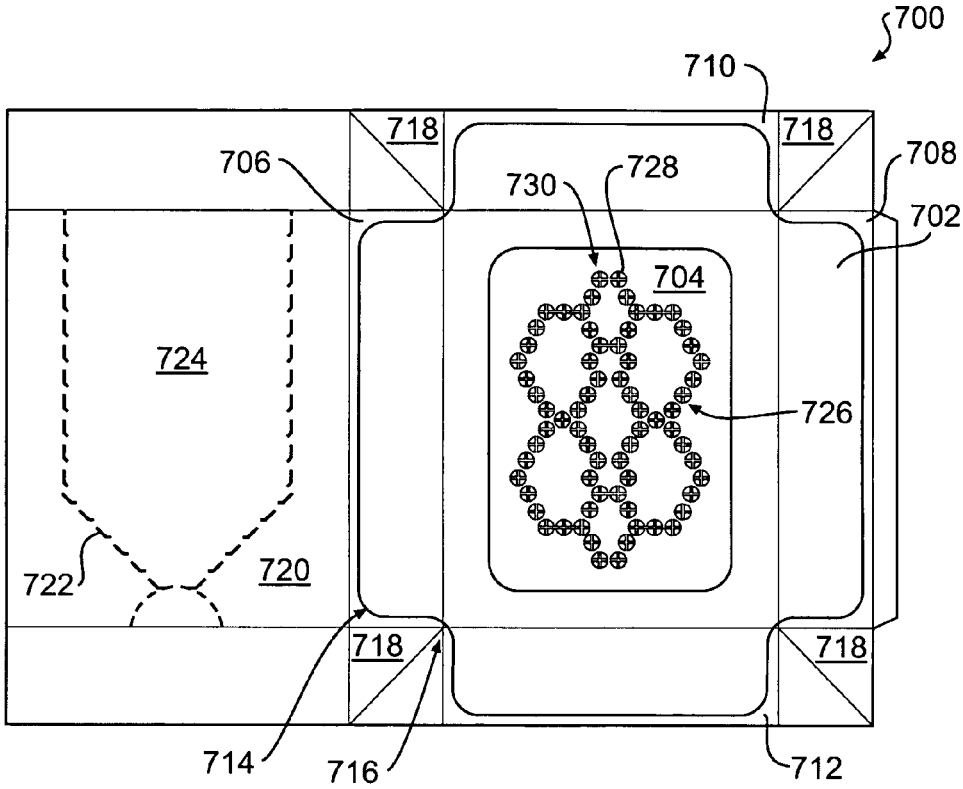
FIG. 7 depicts still another exemplary blank that may be used to form a construct according to the present invention, the blank including a plurality of microwave energy interactive elements.

FIG. 7 illustrates an exemplary blank 700 including microwave energy interactive elements that may be used to form a construct according to the invention. The blank 700 includes several features similar to those of FIG. 1, and such features are not discussed again with respect to FIG. 7. In this example, however, the blank 700 includes a first microwave energy interactive element 702 at least partially overlying and at least partially joined to the bottom panel 704 along a peripheral area thereof. The first microwave energy interactive element 702 also at least partially overlies and is at least partially joined to the adjacent panels 706, 708, 710, and 712. The first microwave energy interactive element 702 comprises a metal foil having a thickness sufficient to prevent substantially the passage of microwave energy therethrough. Thus, when formed into a construct (not shown), the microwave energy interactive element 702 acts as a shielding element that prevents a food item within the construct from overheating, drying, or scorching.

If desired, the first microwave energy interactive element 702 may have somewhat rounded external corners 714 and rounded interior corners 716, as shown in FIG. 7. However, it will be understood that the particular configuration of the element on the blank and within a construct formed therefrom may vary for different applications, depending on the need for shielding. For example, if desired, the shielding element may be extended to over all or a portion of the corner panels 718 to achieve the desired heating characteristics. As another example, a shielding element or other microwave energy interactive element may be overlie all or a portion of the top panel 720. Where such an element is provided, it may include physical breaks or discontinuities to accommodate any tear lines 722 that define the removable panel 724. For example, a susceptor may be overlie at least a portion of the removable panel 724, at least a portion of the top panel 720 outside of the removable panel 724, or some combination thereof that does not extend across tear lines 722. By configuring the element or elements in this manner, the user can open and close the construct (not shown) without damaging the microwave energy interactive element or elements.

The blank 700 also includes a second microwave energy interactive element 726 overlying a central area of the bottom panel 704. The second microwave energy interactive element comprises a plurality of microwave energy interactive foil segments 728 arranged in clusters 730 in a lattice-like configuration. In this example, each cluster 730 comprises four foil segments 728, each generally resembling a quarter of a circle. This particular arrangement of segments 728 and clusters 730 tends to distribute microwave energy across the bottom panel 704, thereby heating an adjacent food item (not shown) more evenly. It will be understood that the particular arrangement of segments 728 and clusters 730 may vary for different applications, and that any such arrangement is contemplated hereby.

In the example shown in FIG. 7, the microwave interactive elements 702 and 726 may be supported on a colorless, transparent polymeric film substrate (not shown in detail) and at least partially joined to an opaque, for example, white, paper or paperboard support (not shown in detail). The microwave interactive elements 702 and 726 have a grey or silver color and, therefore, are visually distinguishable from the other materials that form the blank 700. While this may be desirable in some circumstances, it is contemplated that it also may be desirable in other circumstances to provide a microwave interactive web or resulting construct having a uniform color and/or appearance. Such a web or construct may be more aesthetically pleasing to a consumer, particularly when the consumer is accustomed to constructs having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive elements, using a dark toned substrate, for example, a black toned substrate, to conceal the presence of the silver or grey toned microwave interactive elements, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive elements, or any other suitable technique or combination thereof. It also contemplates using a microwave energy transparent support, for example, paperboard, that is tinted to match or otherwise obscure the silver color of the microwave energy interactive elements.

In another example, the construct may be formed at least partially from a microwave energy interactive insulating material. As used herein, the term "microwave energy interactive insulating material" or "insulating material" refers any combination of layers of materials that is both responsive to microwave energy and capable of providing some degree of thermal insulation when used to heat a food item.

The insulating material may include various components, provided that each is resistant to softening, scorching, combusting, or degrading at typical microwave oven heating temperatures, for example, at about 250° F. The insulating material may include both microwave energy responsive or interactive components, and microwave energy transparent or inactive components.

In one aspect, the insulating material comprises one or more susceptor layers in combination with one or more expandable insulating cells. Additionally, the insulating material may include one or more microwave energy transparent or inactive materials to provide dimensional stability, to improve ease of handling the microwave energy interactive material, and/or to prevent contact between the microwave energy interactive material and the food item. For example, an insulating material may comprise a microwave energy interactive material supported on a first polymeric film layer, a moisture-containing layer superposed with the microwave energy interactive material and a second polymeric film layer joined to the moisture-containing layer in a predetermined pattern, thereby forming one or more closed cells between the moisture-containing layer and the second polymeric film layer. The closed cells expand or inflate in response to being exposed to microwave energy, and thereby causing microwave energy interactive material to bulge and deform.

Several exemplary insulating materials are depicted in FIGS. 8A-10. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 8A:
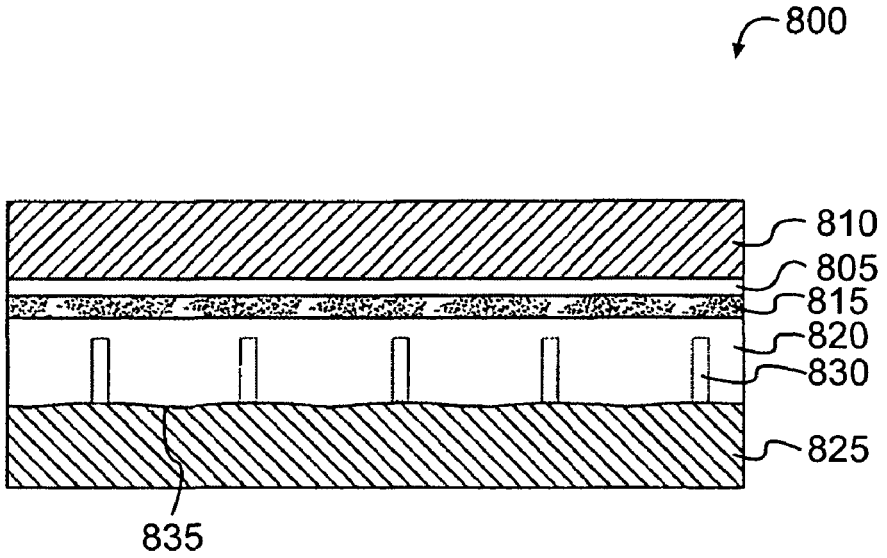
FIG. 8A depicts an exemplary microwave energy interactive insulating material that may be used according to various aspects of the present invention.
Figure 8B:
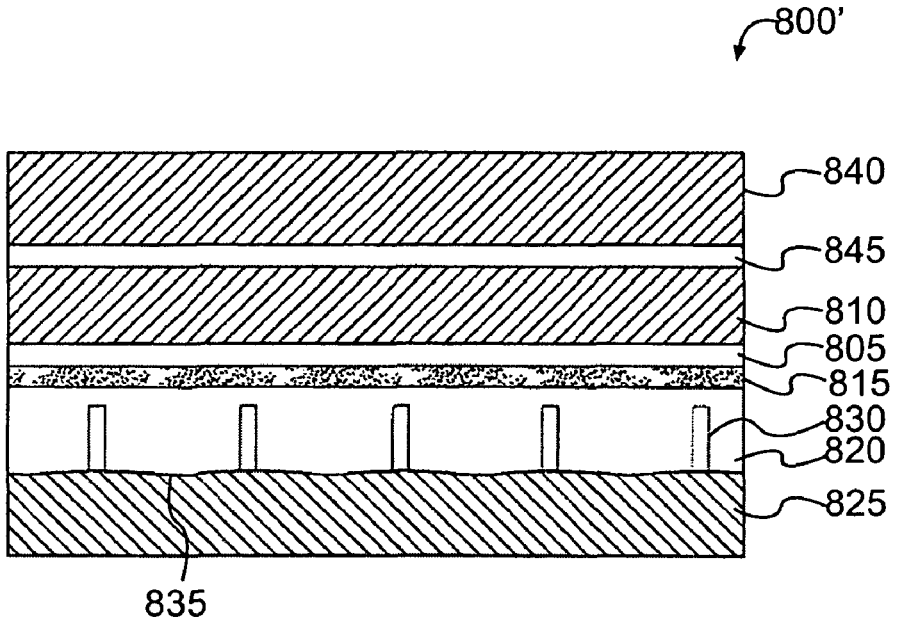
FIG. 8B depicts another exemplary microwave energy interactive insulating material that may be used according to various aspects of the present invention.
Figure 8C:
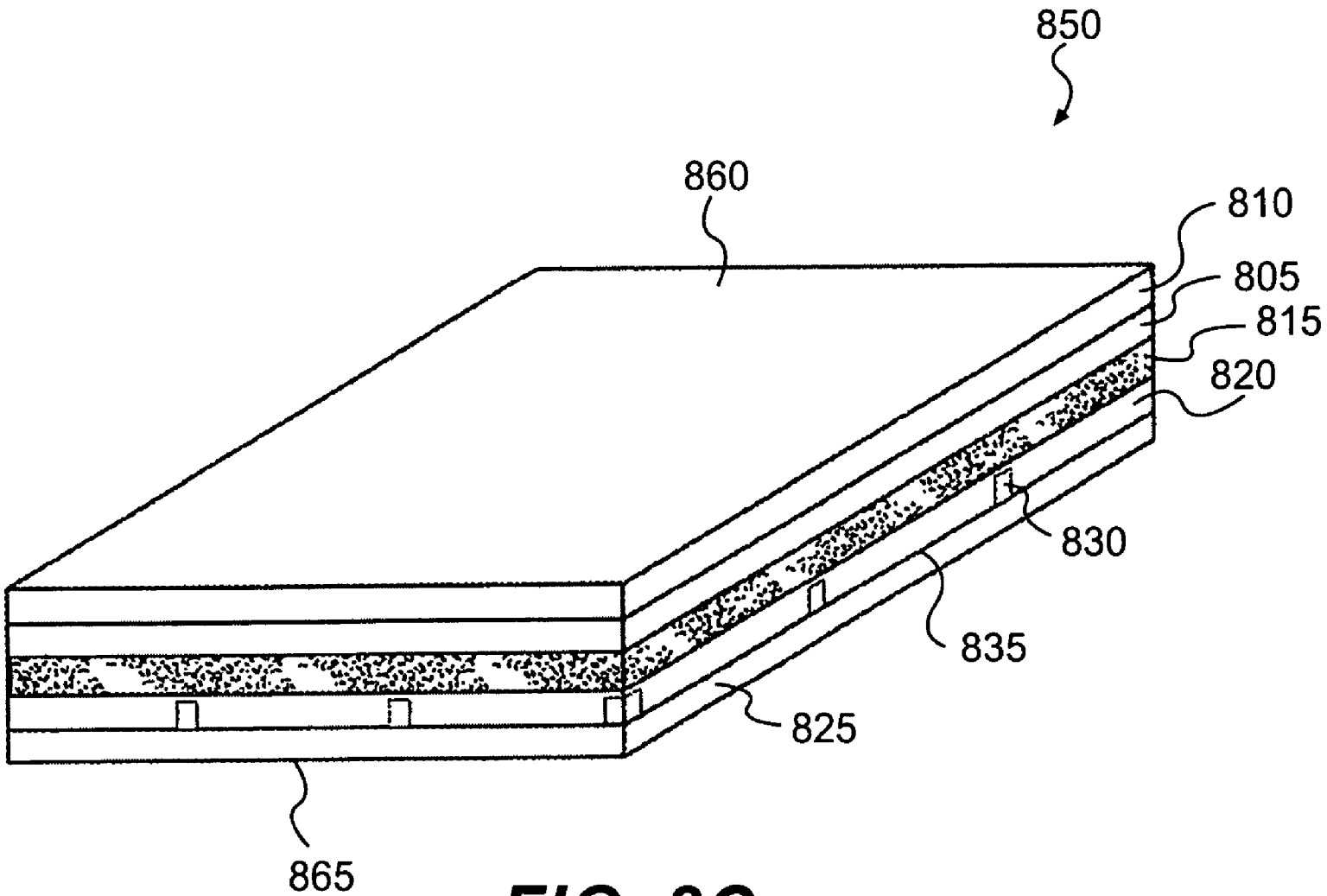
FIG. 8C depicts the exemplary microwave energy interactive insulating material of FIG. 8A in the form of a cut insulating sheet, that may be used according to various aspects of the present invention.

Referring to FIG. 8A, the insulating material 800 may be a combination of several different layers. A susceptor film that includes a thin layer of microwave energy interactive material 805 supported on a first polymer film 810 is bonded by lamination with an adhesive 815 (or otherwise bonded) to a dimensionally stable substrate 820, for example, paper. The substrate 820 is bonded to a second polymer film 825 using a patterned adhesive 830 or other material, such that closed cells 835 are formed in the material 800. The closed cells 835 are substantially resistant to vapor migration. Optionally, an additional microwave transparent layer 840 may be adhered by adhesive 845 or otherwise to the first polymer film 810 opposite the microwave energy interactive material 805, as depicted in FIG. 8B. The additional microwave transparent layer 840 may be a layer of paper, film, or any other suitable material, and may be provided to shield the food item (not shown) from any flakes of susceptor film that craze and peel away from the insulating material 800' during heating. The insulating material 800 may be cut and provided as a substantially flat, multi-layered sheet 850, as shown in FIG. 8C.

Figure 8D:
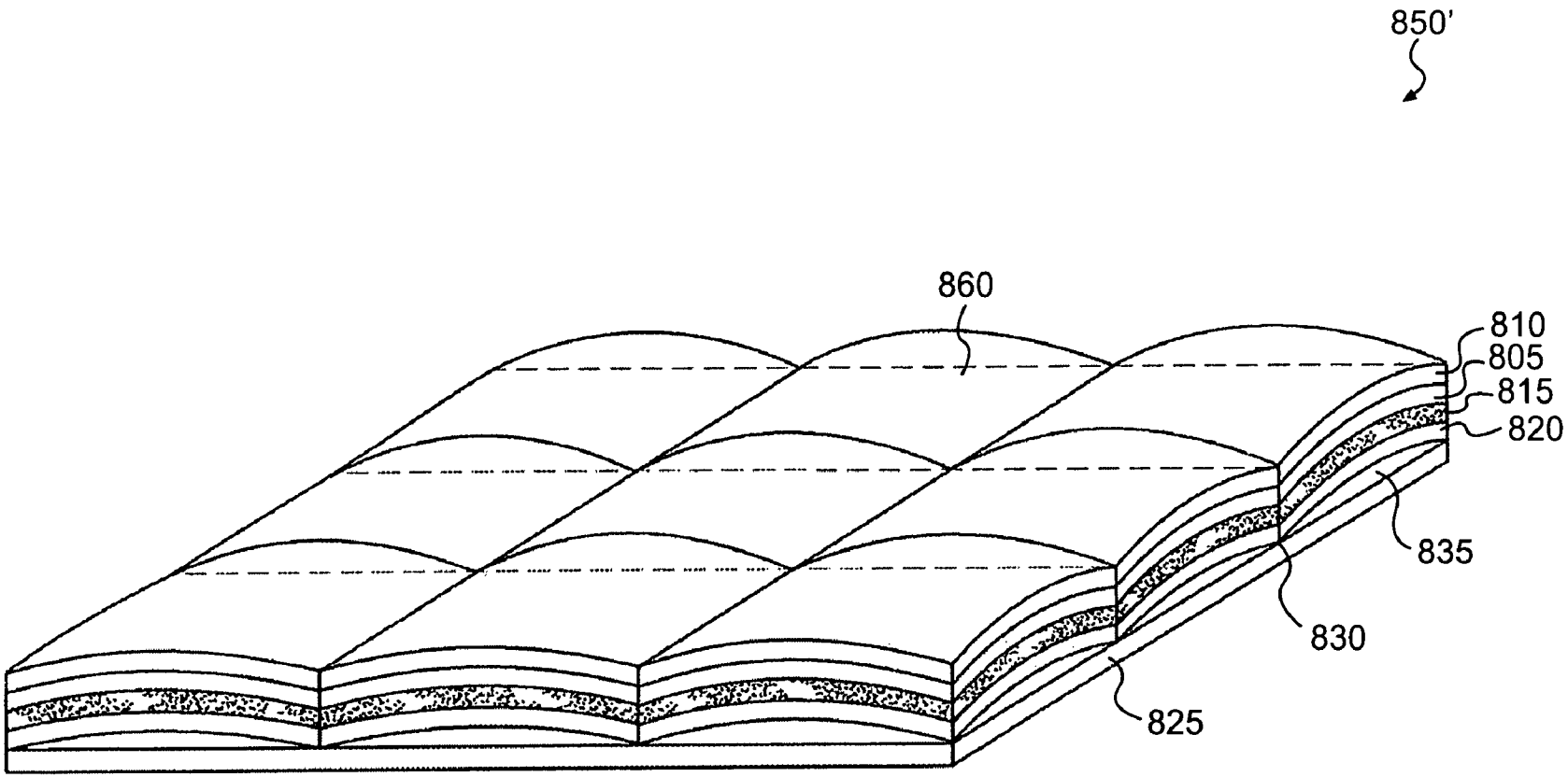
FIG. 8D depicts the insulating sheet of FIG. 8C upon exposure to microwave energy.

As the susceptor heats upon impingement by microwave energy, water vapor and other gases typically held in the substrate 820, for example, paper, and any air trapped in the thin space between the second polymer film 825 and the substrate 820 in the closed cells 835, expand, as shown in FIG. 8D. The expansion of water vapor and air in the closed cells 835 applies pressure on the susceptor film 810 and the substrate 820 on one side and the second polymer film 825 on the other side of the closed cells 835. The various layers forming each side of the closed cells 835 react simultaneously, but uniquely, to the heating and vapor expansion. The cells 835 expand or inflate to form a quilted top surface 860 of pillows separated by channels (not shown) in the susceptor film 810 and substrate 820 lamination, which lofts above a bottom surface 865 formed by the second polymer film 825. This expansion may occur within 1 to 100 seconds in an energized microwave oven and, in some instances, may occur within 2 to 10 seconds. The resulting insulating material 850' has a quilted or pillowed appearance. When microwave heating has ceased, the quilts typically deflate and return to a somewhat flattened state.

In another aspect, the insulating material comprises a durably expandable insulating material. As used herein, the term "durably expandable insulating material" or "durably expandable material" refers to a microwave energy interactive insulating material that includes expandable insulating cells that tend to remain at least partially expanded after exposure to microwave energy has been terminated. In some instances, the cells may remain substantially expanded after exposure to microwave energy has been terminated.

In one example, the durably expandable material comprises one or more reagents or additives that release a gas upon exposure to microwave energy. For example, the additive may comprise a combination of sodium bicarbonate ($NaHCO_3$) and a suitable acid, which react to form carbon dioxide. As the carbon dioxide is released, the gas causes the cells to expand. While certain reagents and gases are described herein, it will be understood that other reagents and released gases are contemplated hereby. The reagents may be incorporated into the durably expandable material in any suitable manner and, in some instances, are coated as a dispersion or a latex onto all or a portion of one or more layers adjacent the expandable cells.

In one example, the durably expandable material comprises a combination of several different layers. A susceptor that includes a thin layer of microwave interactive material on a first plastic film is bonded, for example, by lamination with an adhesive, to a dimensionally stable substrate, for example, paper. The substrate is bonded to a second plastic film using a patterned adhesive or other material, such that closed cells are formed in the material. The closed cells are substantially resistant to vapor migration. A coating comprising one or more reagents that generate a gas upon exposure to microwave energy overlies all or a portion of the microwave energy interactive material. Alternatively, the coating may overlie the substrate.

As the susceptor heats upon impingement by microwave energy, water vapor and other gases normally held in the substrate, for example, paper, and any air trapped in the thin space between the second plastic film and the substrate in the closed cells, expand. The expansion of water vapor and air in the closed cells applies pressure on the susceptor film and the substrate on one side and the second plastic film on the other side of the closed cells. Additionally, depending on the particular reagents selected, the presence of water vapor and/or heat may initiate the reaction between the reagents. The cells expand or inflate to form a quilted top surface of cells, which lofts above a bottom surface formed by the second plastic film. This expansion may occur within 1 to 15 seconds in an energized microwave oven, and in some instances, may occur within 2 to 10 seconds. After the exposure to microwave energy has been terminated, the cells remain inflated.

It will be understood that the various insulating materials of the present invention enhance heating, browning, and crisping of a food item in a microwave oven. First, the water vapor, air, and other gases contained in the closed cells provides insulation between the food item and the ambient environment of the microwave oven, thereby increasing the amount of sensible heat that stays within or is transferred to the food item. Additionally, the formation of the cells allows the material to conform more closely to the surface of the food item, placing the susceptor film in greater proximity to the food item, thereby enhancing browning and/or crisping. Furthermore, insulating materials may help to retain moisture in the food item when cooking in the microwave oven, thereby improving the texture and flavor of the food item. Additional benefits and aspects of such materials are described in PCT Application No. PCT/US03/03779, U.S. Pat. No. 7,019,271, and U.S. Pat. No. 7,351,942, each of which is incorporated by reference herein in its entirety.

Any of the insulating materials described herein or contemplated hereby may include an adhesive pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item and package.

If desired, multiple layers of insulating materials may be used to enhance the insulating properties of the various constructs described herein or contemplated hereby and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor layers are facing away from each other. In another example, two sheets of an insulating material may be arranged so that their respective susceptor layers are facing towards each other. In still another example, multiple sheets of an insulating material may be arranged in a like manner and superposed. In a still further example, multiple sheets of various insulating materials are superposed in any other configuration as needed or desired for a particular application.

Figure 9:
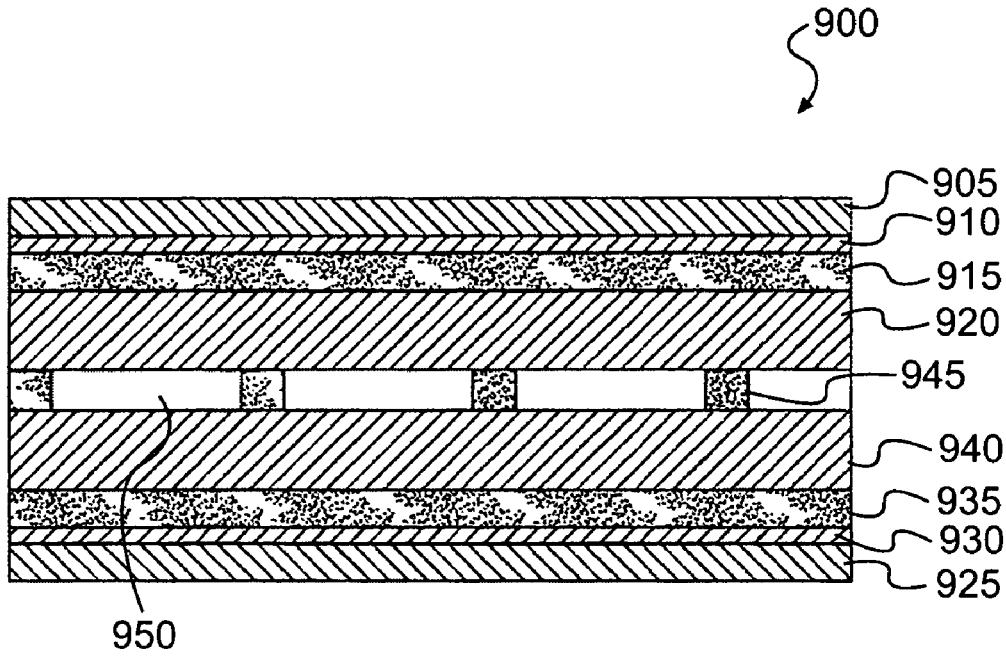
FIG. 9 depicts another exemplary microwave energy interactive insulating material that may be used according to various aspects of the present invention.
Figure 10:
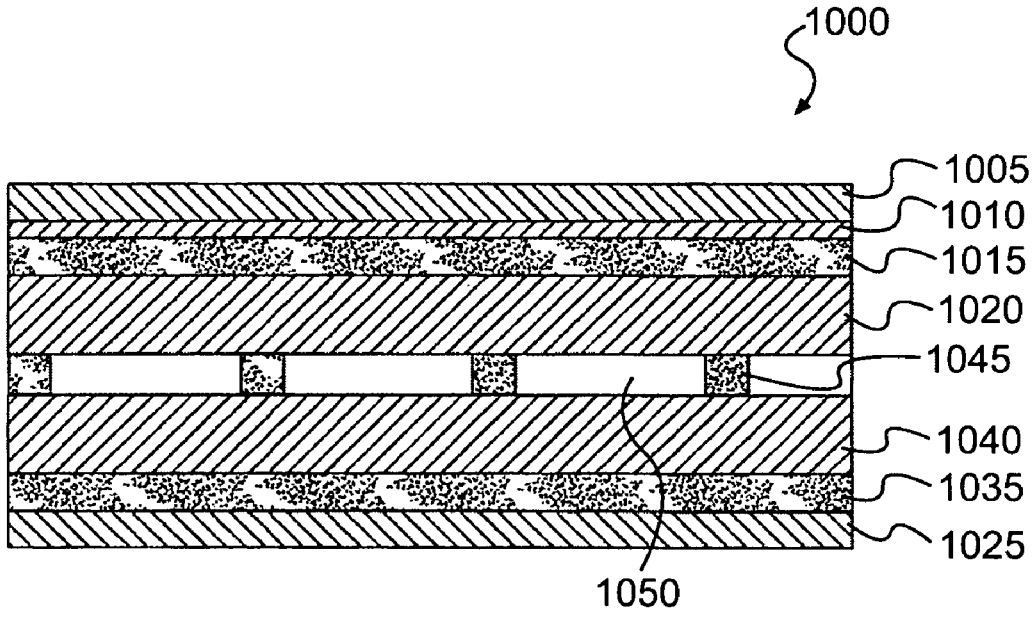
FIG. 10 depicts yet another exemplary microwave energy interactive insulating material that may be used according to various aspects of the present invention.

FIGS. 9 and 10 depict other exemplary insulating materials according to various aspects of the present invention. Referring first to FIG. 9, an insulating material 900 is shown with two symmetrical layer arrangements adhered together by a patterned adhesive layer. The first symmetrical layer arrangement, beginning at the top of the drawings, comprises a PET film layer 905, a metal layer 910, an adhesive layer 915, and a paper or paperboard layer 920. The metal layer 910 may comprise a metal, such as aluminum, deposited along at least a portion of the PET film layer 905. The PET film 905 and metal layer 910 together define a susceptor. The adhesive layer 915 bonds the PET film 905 and the metal layer 910 to the paperboard layer 920.

The second symmetrical layer arrangement, beginning at the bottom of the drawings, also comprises a PET film layer 925, a metal layer 930, an adhesive layer 935, and a paper or paperboard layer 940. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 945 is provided between the two paper layers 920 and 940, and defines a pattern of closed cells 950 configured to expand when exposed to microwave energy. It has been discovered that an insulating material 900 having two metal layers 910 and 930 according to the present invention generates more heat and greater cell loft. As a result, such a material is able to elevate a food item seated thereon to a greater extent than an insulating material having a single microwave energy interactive material layer.

Referring to FIG. 10, yet another insulating material 1000 is shown. The material 1000 includes a PET film layer 1005, a metal layer 1010, an adhesive layer 1015, and a paper layer 1020. Additionally, the material 1000 may include a clear PET film layer 1025, an adhesive layer 1035, and a paper layer 1040. The layers are adhered or affixed by a patterned adhesive 1045 defining a plurality of closed expandable cells 1050.

According to another aspect of the present invention, a carton or other construct including at least one opening feature serves as an outer or secondary container for a food item (not shown) contained within a first or primary container. In such a package configuration or system, the food item is placed into the container, which is placed into the carton and provided to the consumer. The container may be any suitable container and, in one aspect, is a plastic and/or paperboard thermally formed tray. In one particular example, the container is a polyethylene terephthalate tray. The container typically is transparent to microwave energy. The food item is heated in the microwave oven within the container, which is inside the carton.

If desired, one or more microwave energy interactive elements (not shown) may overlie at least a portion of the interior surface of the secondary carton. In contrast with conventional microwave energy interactive constructs that include a microwave energy interactive element in intimate or nearly intimate contact with the food item to be heated, the present invention contemplates use of a secondary, outer carton including one or more microwave energy interactive elements, such that the food item is not in intimate or nearly contact with at least one microwave energy interactive element. As such, the type and configuration of the microwave energy interactive elements may be selected for each type of food item, the mass of the item, the dimensions of the item, and various other characteristics, without having to modify the tray or primary container, which often is designed and provided by individual food item manufacturers. Thus, advantageously, the food manufacturer may use a standard thermally formed food tray if desired, while achieving the benefits associated with use of microwave energy interactive elements.

Figure 11:
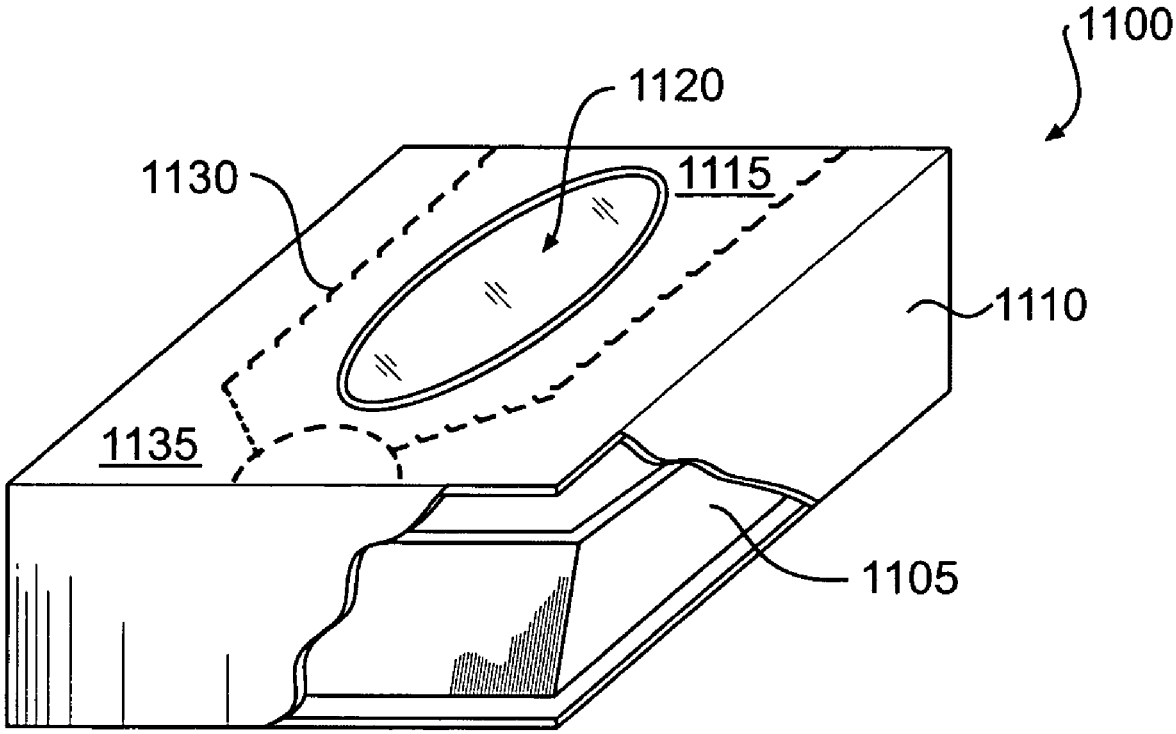
FIG. 11 depicts an exemplary construct according to the present invention used as a secondary carton for a food item contained within a primary container.

FIG. 11 depicts an exemplary package or system 1100 according to the present invention. The package 1100 includes a primary or inner, food holding container 1105 and a secondary or outer, microwave interactive carton 1110. The inner container 1105 may be formed from any suitable material, for example, a polymeric material, a paper, a paperboard, or any combination thereof. In one example, the container

1105 is formed at least partially from polyethylene terephthalate, for example, coextruded polyethylene terephthalate. In another example, the container 1105 is formed at least partially from paperboard.

The microwave energy interactive carton 1110 may be any carton that includes at least one microwave energy interactive element (not shown). In this example, the carton 1110 resembles a carton that could be formed from the blank of FIG. 7 having a removable portion 1115, except that in this example, the carton 1100 also includes a transparent viewing feature or window 1120 that allows the user to view a food item therein (not shown) without opening the carton 1100. The transparent portion or window 1120 generally comprises an opening at least partially covered by a transparent material, for example, polyethylene terephthalate or another polymer film. In one aspect, the transparent material includes an indium tin oxide susceptor film affixed to or integral with the removable portion 1115, typically on the interior surface. Such a susceptor could be used to brown and/or crisp the top surface of a food item within the container 1105.

It will be understood that in this and other aspects of the invention, one or more viewing features may be included, and that such features may have any size, shape, configuration, and location as needed or desired for a particular application. In this example, the user may choose to view the food item (not shown) through the transparent material of the window 1120, and/or may access the interior 1125 of the carton 1110 by using an easy-opening feature, such as by tearing along tear lines 1130 in the top panel 1135. When the food item is heated to the desired temperature, the user may separate the removable portion 1115 at least partially and use other features described herein, for example, additional tear lines (not shown), to remove the container 1105 from the carton 1110.

Various aspects of the present invention are illustrated by the following examples, which are not to be construed in any way as imposing limitations upon the scope thereof. On the contrary, it is to be clearly understood that resort may be had to various other aspects, modifications, and equivalents thereof which, after reading the description herein, may be suggested to one of ordinary skill in the art without departing from the spirit of the present invention.

EXAMPLES

The heating characteristics of a 1.1 kg meat lasagna product in a coextruded polyethylene terephthalate (CPET) tray in a plain carton were compared with those of the same coextruded polyethylene terephthalate tray in an experimental carton according to the present invention. The experimental carton was formed from the blank of FIG. 7.

All lasagnas were cooked without the film lid provided with the lasagna. Two different microwave ovens were used. Microwave oven A was a 900 W GE microwave oven model E1238TWH 001 having a 1.2 cubic foot capacity. Microwave oven B was an 1100 W Panasonic microwave oven model NN-S559WA having a 1.0 cubic foot capacity. The cook time in microwave oven A was 19 minutes and the cook time in microwave oven B was 17 minutes.

A total of thirty-five temperatures were measured in a seven by five grid using Omega Tempscan software. Thermocouple probes were inserted in the food mid-way through the food product after 5 minutes of standing time. The texture of the lasagna along the perimeter of the lasagna was observed and recorded. The degree of cheese melt on the surface of the lasagna also was evaluated. Any other pertinent food quality texture and appearance observations were recorded. The results are indicated in Tables 1-4. In general, the lasagnas that were cooked using the carton of the present invention displayed improved temperature profiles and reduced edge overheating as compared to a plain carton.

TABLE 1

Microwave oven A, CPET tray in plain outer carton

| | MAX | MIN | RANGE | AVE | ST DEV. |
|---|---|---|---|---|---|
| CENTER | 124.4 | 107.7 | 16.7 | 114 | 7 |
| MIDDLE | 167.6 | 81.2 | 86.4 | 177 | 24 |
| PERIPHERY | 202.9 | 137.7 | 65.7 | 177 | 19 |
| OVERALL | 202.9 | 81.2 | 121.7 | 153 | 35 |

OBSERVATIONS

Lasagna burned along full lengths and widths of tray; center cheese slightly overcooked.

TABLE 2

Microwave oven A, CPET tray in experimental carton

| | MAX | MIN | RANGE | AVE | ST DEV. |
|---|---|---|---|---|---|
| CENTER | 136.0 | 131.9 | 4.1 | 134 | 2 |
| MIDDLE | 151.7 | 130.5 | 21.2 | 153 | 6 |
| PERIPHERY | 164.7 | 142.5 | 22.1 | 153 | 6 |
| OVERALL | 164.7 | 130.5 | 34.2 | 148 | 8 |

OBSERVATIONS

Some drying out along but no burning; no discoloration of the carton during heating

TABLE 3

Microwave oven B, CPET tray in plain outer carton

| | MAX | MIN | RANGE | AVE | ST DEV. |
|---|---|---|---|---|---|
| CENTER | 157.1 | 137.8 | 19.3 | 150 | 9 |
| MIDDLE | 160.7 | 108.3 | 52.4 | 149 | 18 |
| PERIPHERY | 162.1 | 131.0 | 31.1 | 149 | 9 |
| OVERALL | 162.1 | 108.3 | 53.8 | 146 | 14 |

OBSERVATIONS

Center cheese crisp but not hard, middle cheese melted well, slight overbaking at corners and edges

TABLE 4

Microwave oven B, CPET tray in experimental carton

| | MAX | MIN | RANGE | AVE | ST DEV. |
|---|---|---|---|---|---|
| CENTER | 167.7 | 163.4 | 4.3 | 165 | 2 |
| MIDDLE | 174.6 | 159.1 | 15.5 | 166 | 5 |
| PERIPHERY | 175.6 | 155.3 | 20.3 | 166 | 6 |
| OVERALL | 175.6 | 155.3 | 20.3 | 166 | 6 |

OBSERVATIONS

Cheese was crisped and hardened at center, edges heated properly and not overcooked; no discoloration of carton during heating In the examples shown herein, the construct is somewhat square or rectangular in shape, suitable, for example, for heating a sandwich or casserole therein. However, it will be understood that in this and other aspects of the invention described herein or contemplated hereby, numerous suitable shapes and configurations may be used to form the various panels and, therefore, constructs. Examples of other shapes encompassed hereby include, but are not limited to, polygons, circles, ovals, cylinders, prisms, spheres, polyhedrons, and ellipsoids. The shape of each panel may be determined largely by the shape of the food item, and it should be understood that different packages are contemplated for different food items, for example, sandwiches, pizzas, French fries, soft pretzels, pizza bites, cheese sticks, pastries, doughs, and so forth.

Likewise, the construct may include gussets, pleats, or any other feature needed or desired to accommodate a particular food item and/or portion size. Additionally, it will be understood that the present invention contemplates blanks and constructs for single-serving portions and for multiple-serving portions.

It also will be understood that in each of the various blanks and constructs described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness; and various combinations of these features.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks also can be referred to as a "cut line", since the nicks typically are a relatively small percentage of the subject line, and alternatively, the nicks can be omitted from such a cut line. As stated above, where cutting is used to provide a fold line, the cutting typically will not be overly extensive in a manner that might cause a reasonable user to consider incorrectly the fold line to be a tear line. Likewise, where nicks are present in a cut line (e.g., tear line), typically the nicks will not be overly large or overly numerous in a manner that might cause a reasonable user to consider incorrectly the subject line to be a fold line.

It is understood that various features described herein, such as lines, panels, and other features, include endpoints, edges, peripheral areas, central areas, corners, and the like, as appropriate. Various exemplary blanks and constructs are shown and/or described herein as having fold lines, tear lines, score lines, cut lines, kiss cut lines, and other lines extending from a particular feature to another particular feature, for example, from one particular panel to another or from one particular edge to another, or are described as being coterminous with one another. However, it will be understood that such lines need not necessarily extend to or between such features in a precise manner. Instead, such lines may generally extend between the various features as needed to achieve the objective of such line. For example, where a particular tear line is shown as extending from a first edge of a blank to another edge of the blank, the tear line need not extend completely to one or both of such edges. Rather, the tear line need only extend to a location sufficiently proximate to the edge so that the tear line is operative without causing undesirable damage to the blank. As another example, where a particular tear line is said to be coterminous with another tear line, the tear lines need not extend completely to one another. Rather, the endpoint of each tear line need only extend to a location sufficiently proximate to the other such that the tear lines are substantially coterminous or "operatively coterminous" or "functionally coterminous", that is, the tear lines are capable of functioning as a coterminous or continuous tear line even though there is some distance between them. Thus, use of the term "coterminous" herein refers to lines or other features that are substantially coterminous or operatively coterminous.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A container system for heating food in a microwave oven, comprising:

an inner container consisting essentially of microwave energy transparent material, the inner container for receiving a food item having a top surface, a side surface that is prone to overdrying when exposed to microwave energy, and an interior area that is prone to underheating when exposed to microwave energy; and an outer container for receiving the inner container, the outer container including a top panel including a plurality of tear lines that define a removable portion, the removable portion including a viewing window comprising a polymer film through which the top surface of the food item can be viewed, a bottom panel opposite the top panel, the bottom panel including a microwave energy distributing element comprising a plurality of metal segments arranged to direct microwave energy to heat the interior area of the food item, and a microwave energy transparent area circumscribing the microwave energy distributing element, wherein the plurality of metal segments of the microwave energy distributing element are spaced apart from one another and arranged in a plurality of clusters, the plurality of clusters each comprising four metal segments, the metal segments each resembling a quadrant of a circle, a plurality of upstanding walls joining the top panel and the bottom panel, and a microwave energy shielding element joined to a peripheral area of the bottom panel and extending at least partially upwardly along the side walls, the microwave energy shielding element being positioned to reduce transmission of microwave energy to the side surface of the food item, wherein the inner container is within the outer container, and at least a portion of the inner container is spaced from the outer container, such that the food item is spaced from at least one of the plurality of metal segments of the outer container, and the microwave energy shielding element of the outer container.

2. The system of claim 1, wherein the microwave energy distributing element is substantially centered on the bottom panel of the outer container.

3. The system of claim 1, wherein the metal segments of the microwave energy distributing element are arranged as a plurality of loops.

4. The system of claim 1, wherein the plurality of clusters are arranged in a lattice-like configuration.

5. The system of claim 1, wherein the viewing window comprises a susceptor film.

6. The system of claim 5, wherein the susceptor film comprises indium tin oxide supported on the polymer film.

7. The system of claim 1, wherein the viewing window does not extend across any of the plurality of tear lines.

8. The system of claim 1, wherein the inner container is formed from polyethylene terephthalate, and the outer container is formed from paperboard.

9. A container system for heating food in a microwave oven, comprising:

an inner container for receiving a food item to be heated in a microwave oven, the inner container being substantially devoid of microwave energy interactive material; and an outer container for receiving the inner container, the outer container including a top panel including a plurality of tear lines that define a removable portion, the removable portion including a viewing window comprising a polymer film through which a top surface of the food item can be viewed, a bottom panel opposite the top panel, the bottom panel including a plurality of metal segments arranged to direct microwave energy toward the center of the inner container, and a microwave energy transparent area circumscribing the metal segments, wherein the plurality of metal segments are spaced apart from one another and arranged in a plurality of clusters, the plurality of clusters each comprising four metal segments, the metal segments each resembling a quadrant of a circle, a plurality of upstanding walls extending substantially between the top panel and the bottom panel, and a microwave energy shielding element mounted to a peripheral area of the bottom panel and extending at least partially upwardly along the side walls, wherein the inner container is within the outer container, and at least a portion of the inner container is spaced from the outer container, such that the food item is spaced from at least one of the plurality of metal segments of the outer container, and the microwave energy shielding element of the outer container.

10. The system of claim 9, wherein the metal segments are arranged as a plurality of loops.

11. The system of claim 10, wherein the plurality of loops are substantially centered on the bottom panel of the outer container.

12. The system of claim 9, wherein the plurality of clusters are arranged in a lattice-like configuration.

13. The system of claim 9, wherein the viewing window comprises a susceptor film.

14. The system of claim 13, wherein the susceptor film comprises indium tin oxide supported on the polymer film.

15. The system of claim 9, wherein the tear lines do not extend into the walls.

16. The system of claim 9, wherein the inner container is formed from polyethylene terephthalate, and the outer container is formed from paperboard.

17. A container system for heating food in a microwave oven, comprising:

an inner container consisting essentially of microwave energy transparent material, the inner container for receiving a food item having a top surface, a side surface that is prone to overdrying when exposed to microwave energy, and an interior area that is prone to underheating when exposed to microwave energy; and an outer container for receiving the inner container, the outer container including a top panel including a plurality of tear lines that define a removable portion, the removable portion including a viewing window comprising a polymer film through which the top surface of the food item can be viewed, a bottom panel opposite the top panel, the bottom panel including a microwave energy distributing element comprising a plurality of metal segments arranged to direct microwave energy to heat the interior area of the food item, and a microwave energy transparent area circumscribing the microwave energy distributing element, wherein the metal segments of the microwave energy distributing element are spaced apart from one another and arranged in a plurality of clusters, the plurality of spaced apart metal segments in each of the clusters comprising four metal segments, each metal segment resembling a quadrant of a circle, a plurality of upstanding walls joining the top panel and the bottom panel, and a microwave energy shielding element joined to a peripheral area of the bottom panel and extending at least partially upwardly along the side walls, the microwave energy shielding element being positioned to reduce transmission of microwave energy to the side surface of the food item.

18. The system of claim 17, wherein the microwave energy distributing element is substantially centered on the bottom panel of the outer container.

19. The system of claim 17, wherein the metal segments of the microwave energy distributing element are arranged as a plurality of loops.

20. The system of claim 17, wherein the plurality of clusters are arranged in a lattice-like configuration.

21. The system of claim 17, wherein the viewing window comprises a susceptor film.

22. The system of claim 21, wherein the susceptor film comprises indium tin oxide supported on the polymer film.

23. The system of claim 17, wherein the viewing window does not extend across any of the plurality of tear lines.

24. The system of claim 17, wherein the inner container is formed from polyethylene terephthalate, and the outer container is formed from paperboard.

25. The system of claim 17, wherein the inner container is within the outer container.

26. A container system for heating food in a microwave oven, comprising:

an inner container for receiving a food item to be heated in a microwave oven, the inner container being substantially devoid of microwave energy interactive material; and an outer container for receiving the inner container, the outer container including a top panel including a plurality of tear lines that define a removable portion, the removable portion including a viewing window comprising a polymer film through which a top surface of the food item can be viewed, a bottom panel opposite the top panel, the bottom panel including a plurality of metal segments arranged to direct microwave energy toward the center of the inner container, and a microwave energy transparent area circumscribing the metal segments, wherein the metal segments are spaced apart from one another and arranged in a plurality of clusters, the plurality of spaced apart metal segments in each of the clusters comprising four metal segments, each metal segment resembling a quadrant of a circle, a plurality of upstanding walls extending substantially between the top panel and the bottom panel, and a microwave energy shielding element mounted to a peripheral area of the bottom panel and extending at least partially upwardly along the side walls.

27. The system of claim 26, wherein the microwave energy distributing element is substantially centered on the bottom panel of the outer container.

28. The system of claim 26, wherein the metal segments of the microwave energy distributing element are arranged as a plurality of loops.

29. The system of claim 26, wherein the plurality of clusters are arranged in a lattice-like configuration.

30. The system of claim 26, wherein the viewing window comprises a susceptor film.

31. The system of claim 30, wherein the susceptor film comprises indium tin oxide supported on the polymer film.

32. The system of claim 26, wherein the viewing window does not extend across any of the plurality of tear lines.

33. The system of claim 26, wherein the inner container is formed from polyethylene terephthalate, and the outer container is formed from paperboard.

34. The system of claim 26, wherein the inner container is within the outer container.

* * * * *